US005829100A

United States Patent [19]

Stentenbach

[11] Patent Number: 5,829,100

[45] Date of Patent: Nov. 3, 1998

[54] SLIVER CAN SPRING PLATE RETAINING DEVICE

[75] Inventor: Udo Stentenbach, Nordhorn, Germany

[73] Assignee: Rosink GmbH & Co. KG, Nordhorn, Germany

[21] Appl. No.: 879,183

[22] Filed: Jun. 20, 1997

[30] Foreign Application Priority Data

Mar. 25, 1996 [DE] Germany ..... 196 11 748.8
Jun. 22, 1996 [DE] Germany ..... 196 25 087.0

[51] Int. Cl.[6] ..... B65H 54/80

[52] U.S. Cl. ..... 19/159 R; 242/381

[58] Field of Search ..... 19/159 R; 206/388; 57/281; 242/381, 396.5, 396.6, 376, 381.6, 382, 384.7

[56] References Cited

U.S. PATENT DOCUMENTS

| | | | |
|---|---|---|---|
| 2,018,261 | 10/1935 | Holdsworth | 19/159 R |
| 2,478,960 | 8/1949 | Wilkie . | |
| 3,263,939 | 8/1966 | Menkin . | |
| 3,971,521 | 7/1976 | Crotti | 19/159 R |
| 4,009,844 | 3/1977 | Gomez | 242/381 |
| 4,193,565 | 3/1980 | Tamura | 242/381 |
| 4,197,614 | 4/1980 | Kriechbaum | 19/159 R |
| 4,293,058 | 10/1981 | Burton | 242/381 |

FOREIGN PATENT DOCUMENTS

| | | | |
|---|---|---|---|
| 0255880 | 2/1988 | European Pat. Off. . | |
| 0449246 | 10/1991 | European Pat. Off. . | |
| 2626011 | 12/1977 | Germany . | |
| 2712982 | 10/1978 | Germany . | |
| 1171529 | 11/1969 | United Kingdom | 19/159 R |

*Primary Examiner*—Ismael Izaguirre
*Attorney, Agent, or Firm*—Robert W. Becker & Associates

[57] ABSTRACT

A sliver can for receiving a sliver has a can body with an open upper end. A spring plate is vertically moveable by a verticle travel stroke in the can body. At least one spring is arranged in the can body biasing the spring plate upwardly into a rest position. The spring plate is downwardly moveable against the force of the at least one spring by the weight force of a sliver received in the can body. A retaining device is connected to the spring plate and acts on the spring plate for preventing a return movement of the spring plate into the rest position over the entire length of the vertical travel stroke. The retaining device includes a locking element for locking the spring plate against the force of the at least one spring.

8 Claims, 3 Drawing Sheets

SLIVER CAN SPRING PLATE RETAINING DEVICE

BACKGROUND OF THE INVENTION

The present invention relates to a sliver can for a controlled placement of sliver, the sliver can comprising an upwardly open can body. A spring plate is vertically moveable within the can body by the weight force of the placed sliver and is biased from below by the force of at least one spring. A retaining device for the spring plate is provided.

Sliver cans are used in order to receive spun material which is comprised of a fleece-like band of stretched parallel fibers. The introduction of the sliver into the sliver can takes place such that the sliver exiting from the exit of the can feeding creel is circularly reciprocated and filled into the can body which is driven about its axis. Thus, loops are formed that are placed one above the other onto the spring plate which is biased by the pressure spring from below. Under the effect of the weight of the thus placed spun material, the spring plate moves downwardly counter to the force of the spring whereby the selection of the spring with a suitable spring characteristic maintains the level of the spun material within the can body independent of the amount of already placed sliver. The can is filled when the spring plate abuts the bottom of the can body whereby the spring has been compressed to its smallest possible size. In order to ensure the aforementioned level compensation, the pressure force of the spring must be somewhat smaller than the weight force of the placed column of sliver. When the force of the spring, on the other hand, is demensioned too large, this results, when the placement pressure of the can feeding creel is no longer present, in an undesirable upward movement of parts of the sliver out of the sliver can.

For increasing the can filling amount, it is, in general, desirable to increase the pressure exerted by the spring from below onto the spring plate because this requires, in turn, an increased placement pressure which causes an increased pressing force of the newly filled sliver and thus results in an improved degree of filling over all. However, this concept is limited by the aforementioned problems. When the pressure force of the spring is too great, this results, after complete filling of the sliver can and its removal from the can feeding creel, in at least portions of the already placed sliver protruding in a mushroom shape from the upper end of the sliver can. This causes considerable problems during further transport of the filled sliver can.

From European Patent Application 0 255 880 it is known to provide the underside of the spring plate with a rigid locking device which in the lowermost position of the spring plate locks it at the bottom of the sliver can. In this manner, the spring plate, during transport of the filled sliver can and for introduction into a machine downstream in the manufacturing process, is maintained in the lowermost position and the placed sliver can not be upwardly moved out of the can body even when a strong spring is used. However, it is disadvantageous in regard to the embodiment of European Patent Application 0 255 880 that the retaining device in the form of a lock is only effective after the spring plate has already reached its lowermost position within the can body.

A sliver can of the aforementioned kind is also known from German Offenlegungsschrift 27 12 982. With the goal of providing a more dense, compressed filling of the sliver can in mind, it is suggested in this printed document to load the underside of the spring plate, in addition to the conventionally present coil spring, by an auxiliary spring that is supported, with its lower end facing away from the spring plate, on a plate which is height-adjustably positioned within the can body. The plate is provided with clamping elements which can arrest the plate at any desired level within the can body. In this sliver can the spring plate thus is subjected in each height position exclusively to the sum of the spring forces of the two springs. In this context, the auxiliary spring is a follower spring in the sense that its lower end, depending on the clamping state, has a different height level within the can. At the same time, however, the spring plate is subjected always to the force action of this auxiliary spring from below. Thus, when in this sliver can the pressure exerted from above onto the already placed sliver is released, it is still possible that a few layers of the sliver will protrude upwardly from the can in an undesirable manner.

It is therefore an object of the present invention to increase with simple means the degree of filling for a sliver can of the aforementioned kind for a controlled placement of the sliver without having to contend with undesirable outward protrusion of the already placed sliver.

SUMMARY OF THE INVENTION

A sliver can for receiving sliver according to the present invention is primarily characterized by:

- a can body having an open upper end;
- a spring vertically moveable by a vertical travel stroke in the can body;
- at least one spring arranged in the can body for biasing the spring plate upwardly into a rest position, wherein the spring plate is downwardly movable against the force of the at least one spring by a weight force of a sliver received in the can body;
- a retaining device connected to the spring plate and acting on the spring plate for preventing a return movement of the spring plate into the rest position over an entire length of the vertical travel stroke;
- the retaining device comprising a locking element for locking the spring plate against the force of the at least one spring.

The retaining device is connected to the underside of the spring plate.

The can body comprises a bottom plate and the retaining device comprises a flexible, non-elastic tensioning element connected to the underside of the spring plate and to the bottom plate.

The tensioning element is in the form of a scroll spring.

The scroll spring has an inner end, positioned within the area of the bottom plate, externally or internally relative to the can body, and the outer end is fastened to the underside of the spring plate.

The retaining devices may further comprise a reel for receiving the tensioning element, whereby the locking element acts on the reel.

The reel is positioned within the area of the bottom plate externally or internally relative to the can body, and the tensioning element is connected with one end to the underside of the spring plate.

The reel comprises a reeling spring biasing the reel in the direction of winding the tensioning element onto the reel.

The sliver can may further comprise a release element for releasing the locking element.

The release element preferably projects outwardly relative to the can body from the bottom plate.

According to the present invention, it is suggested that the retaining device prevents the spring force-caused return movement of the spring plate, whereby the retaining device is effective over the entire length of the vertical travel stroke that is preformed by the spring plate within the can body and that the retaining device is fastened to the spring plate, preferably to its underside, and provided with at least one locking element that locks the spring plate against the pressure force of the spring.

With these measures there is no risk, even when using a stronger spring, that already placed sliver is forced out of the sliver can. A retaining device is provided that is effective over the entire travel stroke of the spring plate and at least one locking element is provided that locks the spring plate against the force of the spring. This makes it possible, when using a stronger spring, to operate with a greater placement pressure for the sliver during filling of the sliver can so that an improved sliver can filling degree with denser packing of the sliver results. This advantage is independent of the total degree of filling because the retaining device is effective when the sliver can is completely filled as well as when it is partly filled.

It is furthermore advantageous that the retaining device functions independent of the placement speed of the sliver as well as independent of the material properties of the sliver. For the functioning of the retaining device, it is thus of no consequence whether the filling of the sliver can, for example, with a can feeding creel, takes place at high or low feeding speeds. The thickness and compressibility of the sliver to be placed into the sliver can are also of no consequence.

The retaining device is preferably comprised of a flexible and non-elastic tensioning element arranged between the spring plate and the bottom plate of the can body.

According to a first preferred embodiment, the tensioning element is a scroll spring. Such scroll springs have the property to wind themselves up to the predetermined bending tension. The advantage of a scroll spring is that it can be arranged with its inner end in the area of the bottom plate of the can body where it requires minimal space so that the vertical movement of the spring plate in the can body is not limited. According to one embodiment it is suggested that the scroll spring with its inner end is positioned in the area of the bottom plate, external or internal to the can, and that the free stretched end of the scroll spring is connected to the underside of the spring plate.

According to a second embodiment the retaining device is comprised of a flexible and non-elastic tensioning element between the spring plate and the bottom plate of the can body and further comprises a reel for receiving the tensioning element (cable). The reel can be locked by the locking element. The reel can also be positioned in the area below or above the bottom plate of the can body where it requires only a minimal amount of space.

The use of the scroll spring as well as the use of a cable with reel allows for a continuous working of the retaining device so that the spring plate can be locked in any desired height position by the locking element against movement in the upward direction. The tensioning element remains tensioned, because, when using the scroll spring, the scroll spring has the tendency to wind up while, in the case of a cable, the cable is tensioned by the spring-loaded reel.

The invention further provides a release element for the locking element whereby the release element is preferably projecting from the underside of the can body.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 5.

Figure 1:
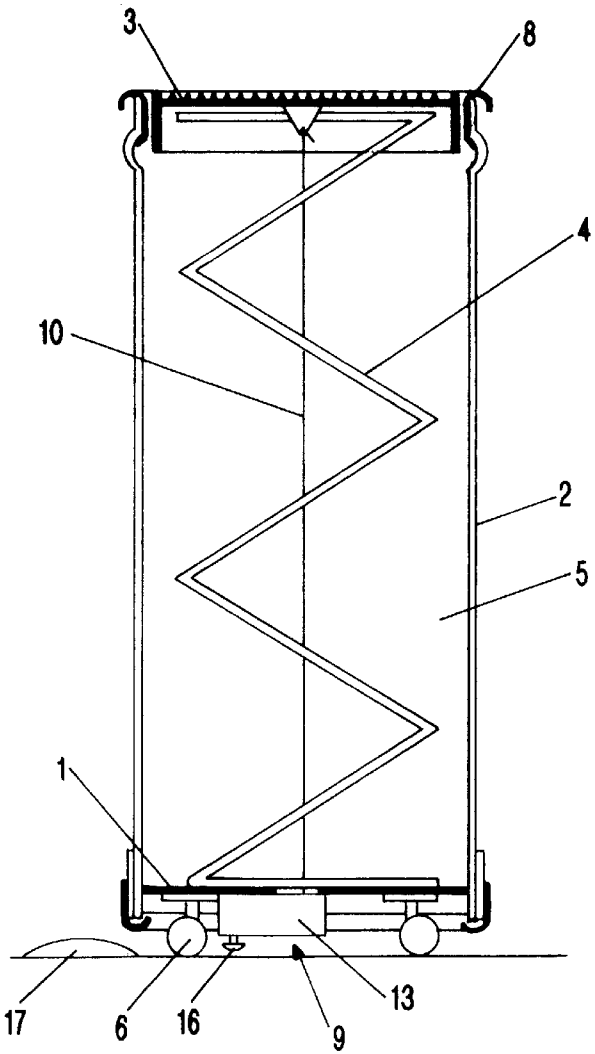
FIG. 1 is a sectional representation of an empty sliver can.

The sliver can represented in FIG. 1 is comprised of a can body 2 which is open in the upward direction and provided with a bottom plate 1. A spring plate 3 is arranged within the can body 2 and cooperates with the spring 4 which, resting on the bottom plate 1, rests from below at the spring plate 3. In the shown embodiment only a single spring 4 in the shape of a coil spring is provided. Alternatively, a plurality of springs may be provided whereby it should be taken into consideration that the spring plate 3 must be substantially horizontally supported.

The spring plate 3 is guided along the inner wall 5 of the can body 2 with minimal play. In the shown embodiment, the can body 2 is cylindrical so that the spring plate 3 has the shape of a circular plate. Wheels 6 at the underside of the sliver can facilitate transport thereof.

Figure 2:
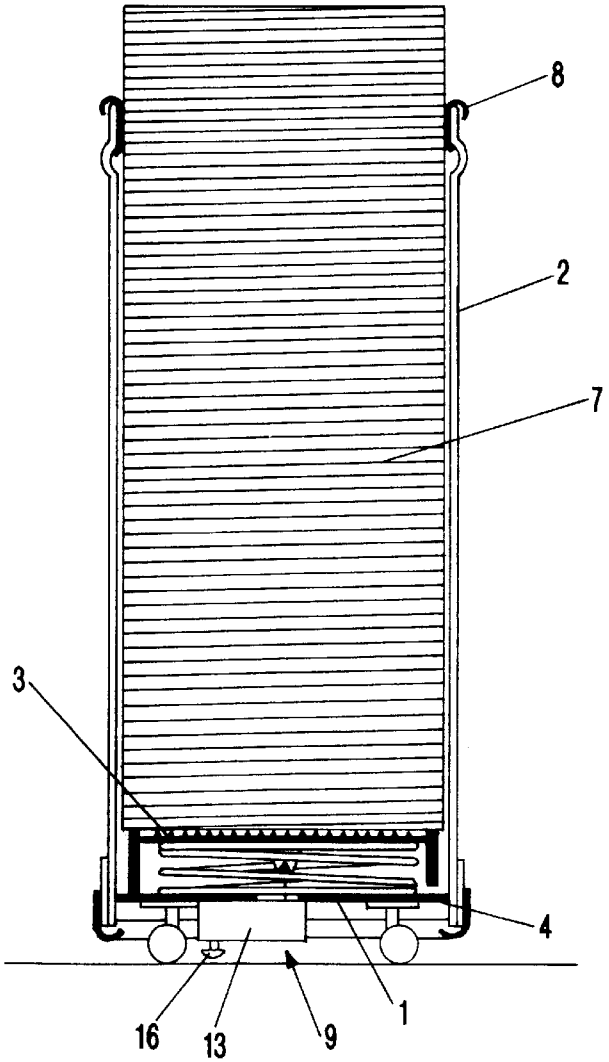
FIG. 2 shows the sliver can of FIG. 1 in a state completely filled with sliver.

The sliver can serves to receive sliver deposited therein in loops or coils. FIG. 2 shows the sliver can in the completely filled state with sliver 7. The spring plate 3 is positioned in its lowermost position in the vicinity of the bottom plate 1. The spring 4 is compressed to the maximum extent.

FIG. 2 illustrates a general problem in relation to sliver cans. The characteristic line of the spring 4 must be adjusted in conventional sliver cans exactly to the properties of the sliver to be deposited in the sliver can. Independent of the height position of spring plate 3 the pressure force exerted by the spring must always be so great that the sliver column resting on the spring plate can not project, as shown in FIG. 2, or can project only to a predetermined height past the upper edge 8 of the can body 2. When the pressure force of the spring is too low, the entire sliver column is immersed within the can body so that the incoming sliver can not be deposited therein with the required pressure. However, when the spring has a pressure force that is too great, an undesirable amount of sliver material will project upwardly from the can body. Due to the above mentioned conditions, it is not possible without problems to increase the characteristic line of the spring 4 and to thus increase the pressure force exerted by it.

However, with the present invention it is possible to use a considerably stronger spring 4 than is known from conventional sliver cans. In order to prevent the aforementioned disadvantages, measures are provided with which the spring plate 3 can be prevented from lifting. For this purpose, a tension loaded retaining device 9 is arranged beneath the spring plate 3. Independent of the height position of the spring plate 3, the retaining device 9 prevents an upward movement of the spring plate 3 from the already assumed position caused by the pressure action of the spring 4. This retaining device 9 can be position-adjusted, i.e., it follows the downward movement of the spring plate 3 during filling with sliver 7, but locks the spring plate 3 in the opposite direction, i.e., against movement in the upward direction.

Figure 3:
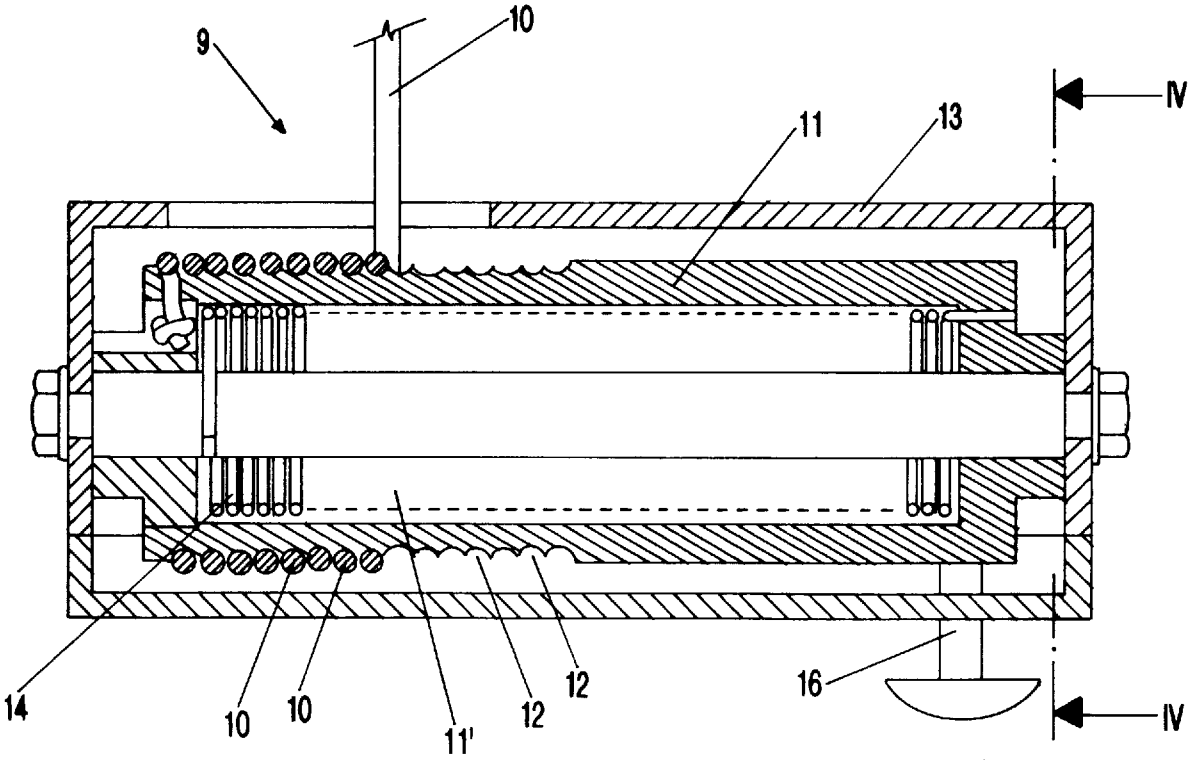
FIG. 3 is an enlarged sectional representation of a detail in the area of the bottom plate of the sliver can according to FIGS. 1 and 2 with a reel connected thereto.
Figure 4:
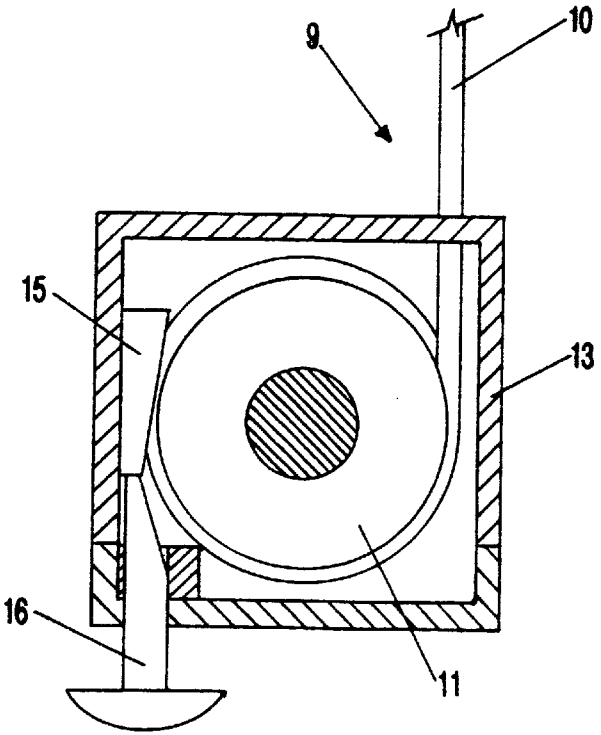
FIG. 4 is a section of the reel of FIG. 3 in the sectional plane IV—IV.

For this purpose, the retaining device 9 in the embodiment shown in FIGS. 3 and 4 is comprised of a tensioning element in the form of a flexible cable. The unneeded length is received on a spring-loaded reel which is supported in the area of the bottom plate 1. The free end of the tensioned tensioning element 10, as is shown in FIG. 1, is connected centrally to the underside of the spring plate 3.

FIG. 3 shows details of the reel 11 arranged within the area of the bottom plate 1. The reel 11 is an elongate drum having at its circumference a coil-shaped groove 12 for receiving the cable windings. The reel 11 is supported with both ends at the housing 13 which is fastened to the bottom plate 1 of the sliver can. In order to maintain tension on the tensioning device 10 between the spring plate 3 and the reel 11, the reel 11 is provided with a spring 14 that tensions the reel in a direction of winding of the tensioning element 10. The reeling spring 14 is a coil spring arranged within the central hollow space 11' of the reel 11. One end of the spring 14 is fastened at the housing while the other is connected to the reel 11 to thereby tension the reel as well as the tensioning element (cable) 10. Due to the thus generated return force of the spring 14, the free end of the tensioning element 10 during lowering of the spring plate 3 is continuously shortened but is always maintained in a tensioned state. In contrast to this spring-supported winding movement a removal is however not possible. This is prevented by a locking element 15 which allows rotation of the reel 11 in the winding direction but locks movement of the reel 11 in the opposite direction. In the shown embodiment, the locking element 15 is a frictional wedge which releases the reel 11 in one direction and prevents movement in the opposite direction by jamming. The locking element 15 can be released by a release element 16 which projects from the underside of the can body 2.

In the embodiment represented in FIGS. 3 and 4 the reel 11 is horizontally positioned. However, it is also possible to use the reel in a vertical position whereby in this case the tensioning element 10 must be deflected by 90° and deposited in multiple layers on the reel.

During placement of the sliver into the described sliver can, the spring plate 3 will move in the downward direction under the influence of the weight of the sliver and the pressure force of the can feeding creel. The return force of the spring 14 of the reel 11 ensures that the tensioning element 10 remains always in a tensioned state. As soon as upon removal of the sliver can from the can feeding creel the additional pressure force of the can feeding creel is removed, the retaining device 9 becomes active. Even though the pressure force of the spring 4 surpasses the weight force of the sliver positioned on the spring plate, the spring plate 3 is locked against movement in the upward directions so that the placed sliver can not be forced upwardly out of the sliver can. Only upon release of the locking element 15 by the release element 16, the reel is released so that the spring plate 3 can then be moved under the action of the spring 4 in the upward direction. This release takes place, in general, after the sliver can has been completely emptied.

Figure 5:
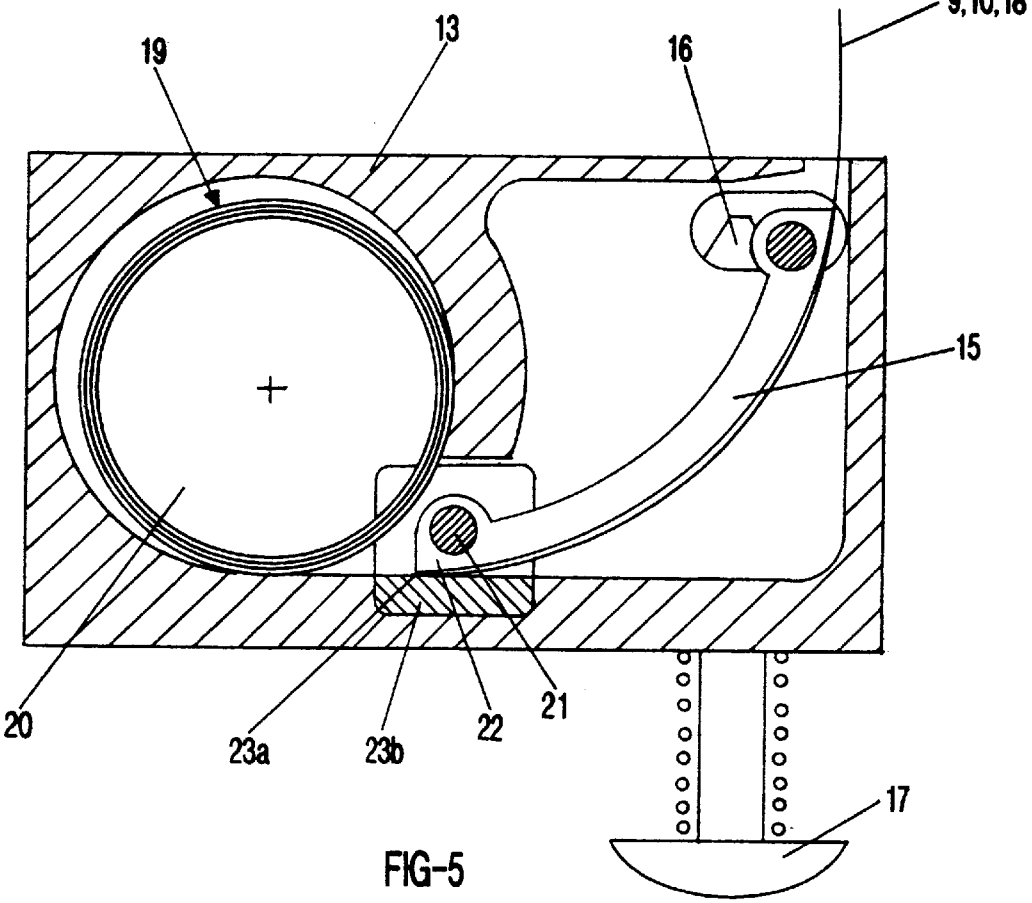
FIG. 5 shows in an enlarged sectional representation a detail in the area of the bottom plate of the sliver can according to FIGS. 1 and 2 with a scroll spring.

In the second embodiment represented in FIG. 5, the retaining device 9, respectively, tensioning element 10 is in the form of a scroll spring 18 the inner end 19 of which is positioned within a cylindrical chamber 20. The scroll spring 18 is a narrow sheet metal strip which, due to its material structure, has the tendency to wind itself up. The free end of the scroll spring 18 is fastened, in analogy to the first embodiment, to the underside of the spring plate 3. Since a scroll spring 18 due to its own tension has the tendency to roll up, an additional spring (corresponding to spring 14 in the embodiment according to FIGS. 3 and 4) is no longer required.

As a locking element 15 a lever is provided which is embodied as a quarter ring and is supported on the axle 21 at the housing. The axle 21 extends parallel to the winding axis. The scroll spring 18 rests at the outer contour of the locking element 15 whereby the free stretched end of the scroll spring 18 leaves the locking element 15 at the end which is facing away from the axle 21. The end of the locking element 15 supported on the axle 21 is provided with a relatively short extension 22 so that the locking element 15 can be viewed as a lever having a lever arm provided by the quarter ring and a short lever arm that is in the form of the extension. This extension 22 at its outer edge provides a clamping cam 23*a* which, under the force of the lever in the form of a quarter ring, presses the scroll spring 18 against the friction-increasing surface 23*b*. The gap between the extension 22 with its clamping cam 23*a* and the oppositely arranged friction-increasing surface 23*b* is so small that the scroll spring 18 barely fits therethrough.

Insofar as the free end of the scroll spring 18 is tension-loaded due to the spring 4 acting on the spring plate 3 of the can body 2, the pivotable locking element 15 has the tendency to force the clamping cam 23*a* against the friction-increasing surface 23*b* in order to clamp in this manner the scroll spring 18. When, on the other hand, the tension force at the free end of the scroll spring 18 is released, the locking element 15 pivots away from the inner end 19 of the scroll spring 18 so that the gap between the clamping cam 23*a* and the friction-increasing surface 23*b* opens and the scroll spring 18 will wind up until the free end is again tightly tensioned.

In the embodiment according to FIG. 5, there is also a release element 16 provided which can be activated by a cam 17. The release element 16 upon actuation pivots the locking element 15 away from the wound end 19 of the scroll spring 18 so that the clamping action is released and the scroll spring 18 winds up under the influence of the great spring 4.

The actuation of the release element 16 can also be performed automatically. For this purpose, cams 17 can be provided at the bottom. Upon passing of the sliver can the cams 17 will exert pressure onto the release element 16 to release the locking element 15.

The characteristic line of the spring 4 is preferably such that its pressure force surpasses the weight force of the sliver placed on the spring plate 3 by at least 10%. This makes it possible to place the sliver with relatively high counter pressure into the sliver can in order to thus improve the degree of filling.

The present invention is, of course, in no way restricted to the specific disclosure of the specification and drawings, but also encompasses any modifications within the scope of the appended claims.

What I claim is:

1. A sliver can for receiving a sliver, said sliver can comprising:

a can body having an open upper end;

a spring plate vertically moveable by a vertical travel stroke in said can body;

at least one spring arranged in said can body for biasing said spring plate upwardly into a rest position, wherein said spring plate is downwardly moveable against the force of said at least one spring by a weight force of a sliver received in said can body;

a retaining device connected to said spring plate and acting on said spring plate for preventing a return movement of said spring plate into said rest position over an entire length of said vertical travel stroke;

said retaining device comprising a locking element for locking said spring plate against the force of said at least one spring;

wherein said retaining device is connected to an underside of said spring plate;

wherein said can body comprises a bottom plate and said retaining device comprises a flexible, non-elastic tensioning element connected to said underside of said spring plate and to said bottom plate;

wherein said tensioning element is a scroll spring.

2. A sliver can according to claim 1, wherein said scroll spring has an inner end, positioned within the area of said bottom plate, externally or internally relative to said can body, and an outer end fastened to said underside of said spring plate.

3. A sliver can according to claim 1, further comprising a release element for releasing said locking element.

4. A sliver can according to claim 3, wherein said release element projects outwardly relative to said can body from said bottom plate.

5. A sliver can for receiving a sliver, said sliver can comprising:

a can body having an open upper end;

a spring plate vertically moveable by a vertical travel stroke in said can body;

at least one spring arranged in said can body for biasing said spring plate upwardly into a rest position, wherein said spring plate is downwardly moveable against the force of said at least one spring by a weight force of a sliver received in said can body;

a retaining device connected to said spring plate and acting on said spring plate for preventing a return movement of said spring plate into said rest position over an entire length of said vertical travel stroke;

said retaining device comprising a locking element for locking said spring plate against the force of said at least one spring;

wherein said retaining device is connected to an underside of said spring plate;

wherein said can body comprises a bottom plate and said retaining device comprises a flexible, non-elastic tensioning element connected to said underside of said spring plate and to said bottom plate;

wherein said retaining device further comprises a reel for receiving said tensioning element, said locking element acting on said reel;

wherein said reel comprises a reeling spring biasing said reel in a direction of winding said tensioning element onto said reel.

6. A sliver can according to claim 5, wherein said reel is positioned within the area of said bottom plate externally or internally relative to said can body and wherein said tensioning element is connected with one end to said underside of said spring plate.

7. A sliver can according to claim 5, further comprising a release element for releasing said locking element.

8. A sliver can according to claim 7, wherein said release element projects outwardly relative to said can body from said bottom plate.

* * * * *

UNITED STATES PATENT AND TRADEMARK OFFICE

CERTIFICATE OF CORRECTION

PATENT NO. : 5,829,100
DATED : 3 November 1998
INVENTOR(S) : Udo Stentenbach

It is certified that error appears in the above-indentified patent and that said Letters Patent is hereby corrected as shown below:

On the title page, item

[30] Foreign Application Priority Data should read

Jun. 22, 1996 [DE] Germany.....196 25 087.0

Signed and Sealed this

Thirtieth Day of March, 1999

*Attest:*

Q. TODD DICKINSON

*Attesting Officer*

*Acting Commissioner of Patents and Trademarks*